US008221253B2

(12) United States Patent
Lidenberg

(10) Patent No.: US 8,221,253 B2
(45) Date of Patent: Jul. 17, 2012

(54) GOLF GRIP TRAINING GLOVE

(76) Inventor: Rodney D. Lidenberg, Eden Prairie, MN (US)

( * ) Notice: Subject to any disclaimer, the term of this patent is extended or adjusted under 35 U.S.C. 154(b) by 6 days.

(21) Appl. No.: 13/039,699

(22) Filed: Mar. 3, 2011

(65) Prior Publication Data

US 2012/0071255 A1 Mar. 22, 2012

Related U.S. Application Data

(60) Provisional application No. 61/404,485, filed on Oct. 5, 2010, provisional application No. 61/403,820, filed on Sep. 22, 2010.

(51) Int. Cl.
*A63B 69/36* (2006.01)

(52) U.S. Cl. ..... 473/205

(58) Field of Classification Search ..... 473/201, 473/205; 2/161.1, 161.2
See application file for complete search history.

(56) References Cited

U.S. PATENT DOCUMENTS

| | | | | |
|---|---|---|---|---|
| 3,848,874 | A * | 11/1974 | Elkins, Jr. | 473/409 |
| 5,184,353 | A * | 2/1993 | Goldwitz | 2/161.4 |
| 5,348,303 | A | 9/1994 | Swissheim | |
| 5,427,376 | A | 6/1995 | Cummings et al. | |
| 5,462,280 | A | 10/1995 | Dickerson | |
| 5,542,126 | A * | 8/1996 | Harvanek | 2/161.2 |
| 5,704,065 | A | 1/1998 | Feuerhake | |
| 5,836,828 | A * | 11/1998 | Sinton | 473/205 |
| 6,022,278 | A | 2/2000 | Vela | |
| 6,363,535 | B1 * | 4/2002 | Landis | 2/161.4 |
| 6,648,770 | B1 | 11/2003 | Snyder | |
| 6,656,054 | B2 | 12/2003 | Ulrich | |
| 6,732,377 | B1 | 5/2004 | Wilkinson | |
| 7,101,286 | B2 * | 9/2006 | Oury | 473/205 |
| 7,207,894 | B2 | 4/2007 | Pine | |
| 7,220,188 | B2 * | 5/2007 | Lee | 473/205 |
| 2004/0025225 | A1 | 2/2004 | Thomson | |
| 2010/0011483 | A1 | 1/2010 | Pinkart | |
| 2010/0077526 | A1 * | 4/2010 | Smeltzer | 2/16 |
| 2010/0186142 | A1 * | 7/2010 | Kume et al. | 2/161.1 |
| 2010/0255921 | A1 * | 10/2010 | Holdridge et al. | 473/205 |
| 2012/0071255 | A1 * | 3/2012 | Lidenberg | 473/205 |

* cited by examiner

*Primary Examiner* — Raleigh W. Chiu
(74) *Attorney, Agent, or Firm* — R. William Graham

(57) ABSTRACT

A golf training aid includes a first upper hand glove having a palm side portion, a back hand side portion, a thumb pocket having a first indicia affixed to the back hand side portion of the upper hand glove to observe the indicia while utilizing a first desirable hand position and a second indicia affixed to the back hand portion to observe the indicia while utilizing a second hand position and a third indicia affixed to the back hand side which corresponds to the first indicia to provide an alignment aid across which a golf club is placed such that a golfer observes the indicia while utilizing said first desirable hand position and a fourth indicia affixed to the back hand side portion corresponding to second indicia to provide an alignment aid across which a golf club is placed to observe the indicia while utilizing the second hand position.

18 Claims, 14 Drawing Sheets

GOLF GRIP TRAINING GLOVE

CROSS-REFERENCE TO RELATED APPLICATION

This application claims the benefit of U.S. Provisional Application No. 61/404,485 filed Oct. 5, 2010 and 61/403,820 filed Sep. 22, 2010.

FIELD OF THE INVENTION

This invention relates in general to a training device for practicing golf skills, and in particular to a training device used to achieve the proper grip on a golf club.

BACKGROUND OF THE INVENTION

In the game of golf, a golfer must swing the golf club to hit the golf ball accurately towards the hole. This swing must be precise and repeatable to reduce the number of strokes required to get the golf ball in the hole. One particular area of concern for the golfer is the manner in which he or she grips the club. A conventional golf glove is placed on the upper hand (the left hand for right-handed golfers) and designed to prevent hand injury due to friction caused by the repetitive motion of swinging the club. However, golf gloves have also been used for various other purposes including as a means to learn the game of golf.

A great deal of time and effort must be invested in learning how to properly grip a golf club. The proper grip is fundamentally important to maintaining a desirable golf swing. Small errors in hand placement can translate into large deviations from the desired golf ball flight pattern. Without repetitive correct positioning of the golfer's hands in a desirable golf club grip, a golfer will have difficulty striking a golf ball with a golf club in the desired manner or develop a correct repeatable and consistent golf swing.

Many golf gloves use fasteners or indicia to improve or increase the consistency of a golfer's grip. The correct positioning of the hands is hard to maintain during the course of the swing. The prior art uses various methods for securing the hands of the apprentice golfer to allow him or her to acquire a consistent grip and thereby making the correct positioning of the golfer's hands feel natural. However, golfers of all skill levels require a method to learn to vary their grip in an orderly and repeatable manner to achieve multiple golf ball flight patterns.

The exact location and nature of the placement of the hand position fastenings and the visual indicia makes a large difference in the outcome of the training method. The positioning of the fastener and indicia are used to secure a specific motor function for the golfer.

For example, U.S. Pat. No. 5,462,280 issued to Dickerson discloses a pair of golf gloves which combine markers, a plurality of hook like members, and felt like material to form a visual indication of the proper hand placement and a means of securing the thumb of the upper hand to the palm of the lower hand to form the correct grip of the club.

Similarly, U.S. Pat. No. 5,542,126 issued to Harvanek discloses a pair of hand gloves which provide a visual indication of an implement, such as a golf club, through the use of markers and other visual indicia. Harvanek provides for multiple "strong" and "weak" grips using a generalized set of indicia. Harvanek does not specify a method for varying the grip in order to achieve multiple desirable golf club grips.

Also, U.S. Pat. No. 6,732,377 issued to Wilkinson discloses a pair of handle-grip and sports gloves which utilize fasteners to allow the golfer to relax his or her grip and still maintain the correct interface with the club.

None of the prior art uses a combination of visual indicia and fasteners in specific locations to allow the golfer for an easily variable, repeatable, and correct grip. Therefore, there is a need for a simple, and easy to manufacture, device which allows a golfer to accurately train a specific and variable grip utilizing a combination of fasteners and visual indicia.

SUMMARY OF THE INVENTION

The gloves facilitate proper hand placement by the golfer when interfacing with a golf club to achieve a desirable golf ball flight pattern. The gloves need not necessarily change the shape of a conventional golf glove, thereby making an embodiment simple and relatively inexpensive to manufacture. The gloves place various indicia and hook and loop type fasteners in specific strategically located positions to train the golfer to learn the correct grip visually, tactually and kinesthetically.

The gloves are equally applicable to right-handed and left-handed golfers without significant modification. The embodiments herein are described as an upper and lower hand. For a right handed golfer, the left hand is the upper hand and the right hand is the lower hand. A left handed golfer uses a further embodiment with only the hand position reversed.

The gloves consistently position a golfer's hands and may thereby train a golfer to swing more accurately and consistently after repeated practice. Proper positioning of a golfer's hands is very important. If a golfer consistently uses a specific grip during the golf swing, the trained grip will result in a more consistent execution of an effective golf swing and the lowering of the golfer's average score. This also improves the achievability and likelihood of an effective golf shot. The gloves may be used as a practice aid for golfers of various skill levels. For example, the gloves can be used while instructing a beginning golfer how to correctly position the golfer's hands during the golf swing. The first hand is placed on the grip of the club in the desired position and then the second hand is positioned over the first hand such that both hands are in contact with each other and the grip of the club. The second hand is below the first hand when the golfer is positioned to begin a golf swing. The various hook and loop type fasteners ensure that the golfer will maintain a desirable golf club grip throughout the golf swing.

The gloves create an easily repeatable, specific motor task for the golfer's hands. This specific motor task is consolidated into memory through repetitive practice. The golfer's skill level is greatly enhanced by the ability to perform a correct swing from memory. A desirable grip ensures that the golfer will train the correct muscle groups in the golfer's hands during a golf swing and thereby consolidate the correct movements into kinesthetic memory.

Visual indicia may be utilized in order to achieve a desirable hand placement. Indicia visible on the exterior of an embodiment must be visually distinct from the underlying material of the glove. The indicia may be individualized for the particular objective of the golfer. Various golf ball flight paths are achievable through the use of different embodiments of the present invention.

Each of the indicia represent a visual guideline for achieving a specific golf ball flight pattern, including but not limited to a straight, fade, or draw shot. In a first embodiment, at least one indicia is affixed to the central glove piece. The indicia provides a visual identification for the desired rotational position of the hand about the club. Each degree of rotation of hand position creates a bias in the golf club relative to the desired target for the ball. A normal golf swing naturally turns the golf club head away from the golfer's body during the swing which creates a tendency for a "slice" in the golf balls flight pattern. For a right-handed golfer, during a "slice" shot, the ball tends to spin in a clockwise direction which in turn causes the ball to move to the right of the desired target for the ball. Therefore, the golf glove trains the golfer through visual indicia to bias the golfers hand position to overcome the natural "slice" problem.

In a further variation, a second indicia on the glove marks a grip designed to provide slightly less compensation for the natural "slicing" bias of a "neutral" swing to achieve a "fade shot" which advantageously causes the golf ball flight pattern to move left of the target line. The second indicia creates a golf ball flight pattern which is superior to the "slice" in that it produces a golf ball flight pattern which is straighter than the undesirable "slice" golf ball flight pattern.

In a further variation, a third indicia on the glove marks a grip designed to provide slightly more compensation for the natural "slicing" bias of a "neutral" swing in order to achieve a "draw shot" which advantageously causes the golf ball flight pattern to move right of the target line. The third indicia creates a golf ball flight pattern which is superior to the "hook" in that it produces a golf ball flight pattern which is straighter than the undesirable "hook" golf ball flight pattern.

Additionally, further indicia may remind a golfer of various desirable golf ball flight pattern. For example, a fourth indicia on the glove may visually correspond to said first indicia to remind the golfer that said first indicia creates a desirable "straight" golf ball flight pattern. A fifth indicia on the glove may visually correspond to a second indicia to remind the golfer that the second indicia creates a desirable "fade" golf ball flight pattern. A sixth indicia on the glove may visually correspond to a third indicia to remind the golfer that the third indicia creates a desirable "draw" golf ball flight pattern. It is obvious to one skilled in the art to remove any one fastener or indicia.

Accordingly, one embodiment is directed to a golf training aid which includes:

a first upper hand glove having a palm side portion, a back hand side portion, a thumb pocket and a plurality of finger pockets characterized by:

a first indicia affixed to said back hand side portion of said upper hand glove such that a golfer observes said indicia while utilizing a first desirable hand position; and a second indicia affixed to said back hand portion of said upper hand glove such that a golfer observes said indicia while utilizing a second hand position; and a third indicia affixed to said back hand side which corresponds to said first indicia to provide an alignment aid across which a golf club is placed such that a golfer observes said indicia while utilizing said first desirable hand position; and a fourth indicia affixed to said back hand side portion which corresponds to said second indicia to provide an alignment aid across which a golf club is placed such that a golfer observes said indicia while utilizing said second hand position. The upper hand glove can include a first pair of fasteners affixed to said first upper hand glove on said thumb pocket and a first finger pocket such that said first pair of fasteners will releasably connect so a golfer's thumb will remain in a desirable location relative to the golf club throughout the course of a golf swing.

A second lower hand glove is preferably provided having a palm side portion, a back hand side portion, a thumb pocket and a plurality of finger pockets characterized by a first lower hand indicia affixed to said back hand side portion of said lower hand such that a golfer may be reminded of said first desirable golf ball flight pattern. The lower glove includes a second lower hand indicia affixed to said back hand side portion of said lower hand such that a golfer may be reminded of said second desirable golf ball flight pattern and a third lower hand indicia affixed to said back hand side portion of said lower hand such that a golfer may be reminded of said third desirable golf ball flight pattern. The lower glove preferably includes a second lower hand glove having a palm side portion, a back hand side portion, a thumb pocket and a plurality of finger pockets a second pair of fasteners affixed to said lower hand glove on said thumb pocket and a first finger pocket such that said second pair of fasteners will releasably connect so the golfer's thumb will remain in a desirable location relative to each other and golf club throughout the course of a golf swing.

The gloves may be used with different types of golf clubs including woods, irons, putters and any hybrids of the aforementioned clubs.

Therefore, the gloves facilitate the proper hand position for any swing. The gloves also allow the golfer to quickly and easily modify the positioning of the golfers hands to another desirable hand position to achieve a desirable variation on the golf ball's flight pattern.

Additionally, the gloves provide an improved hand position having markers thereon to facilitate the proper placement of the golfer's hands.

Other objects of the invention will become apparent as the description proceeds in connection with the accompanying drawings.

DETAILED DESCRIPTION

Figure 1:
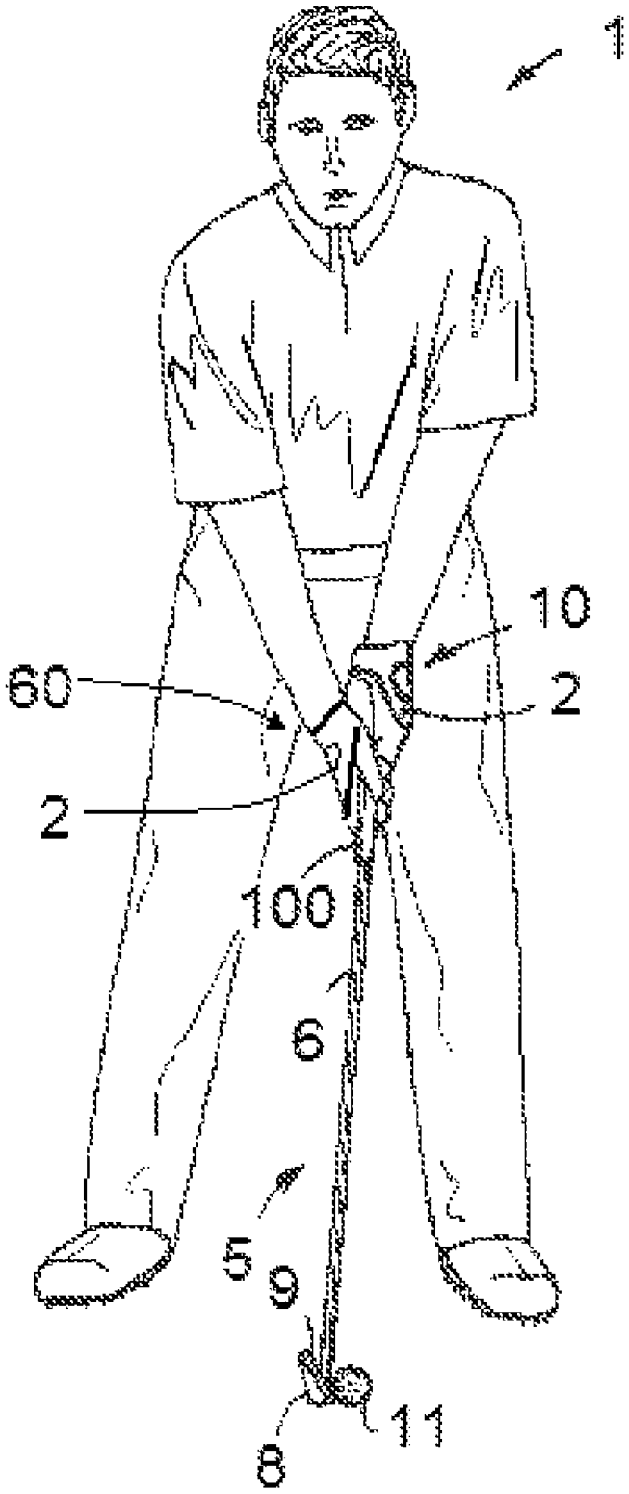
FIG. 1 is a perspective view of a golfer using an embodiment of the Golf Grip Training Glove.

A golfer 1, as shown in FIG. 1, is holding a conventional golf club 5 in a position to hit a golf ball 11. Golfer 1 is positioned in a correct golf stance and is thereby prepared to swing golf club 5 to hit golf ball 11 in the desired direction. Visual indicia 2 may only be utilized from this position. Golf club 5 has a tapered cylindrical shaft 6 accommodating a tapered cylindrical grip 100 and is attached to a head 8, shown as an iron, having an upwardly and rearwardly inclined face 9. A glove 10 positioned on the golfer's left hand is used to grasp or firmly hold golf club 5. Before the golf club 5 is grasped, palms of the golfer's hands are faced down so that the golfer's left hand fingers will clutch grip 100. This helps the golfer to swing golf club 5 more precisely and reliably, thereby increasing distance and accuracy of the flight of a golf ball 11 and reduce undesirable results in the flight pattern of golf ball 11.

FIGS. 2-5 illustrate a first right handed embodiment of a pair of golf grip training gloves 10, 60. In the first embodiment, hook and loop fasteners 41, 42, 43, 44, 45, 46, 47, 48, 49, 51, 52, 53, 54, 55, 56, 57 are combined with visual indicia 2, 71, 72, 73 to form a self-adhering grip which teaches the user through motor memory to correctly grip the golf club grip 100. All fasteners may be hook pads affixed to the fabric of the glove while an opposing mating pad may be a loop pad such that where the two pads are in contact, they may securely mate with enough frictional strength to survive the forces applied by the swinging action of the club. In the alternative, any hook pad may be substituted with a loop pad where the opposite mating pad is also switched to a hook pad.

Alternatively, may fasteners may be affixed to golf gloves 10, 60 using any suitable technique for permanently attaching two natural or synthetic polymers, such as sewing, adhering or otherwise chemically bonding such fasteners to the desired location. The fasteners and indicia may be used to retrofit any conventional golf glove.

Figure 2:
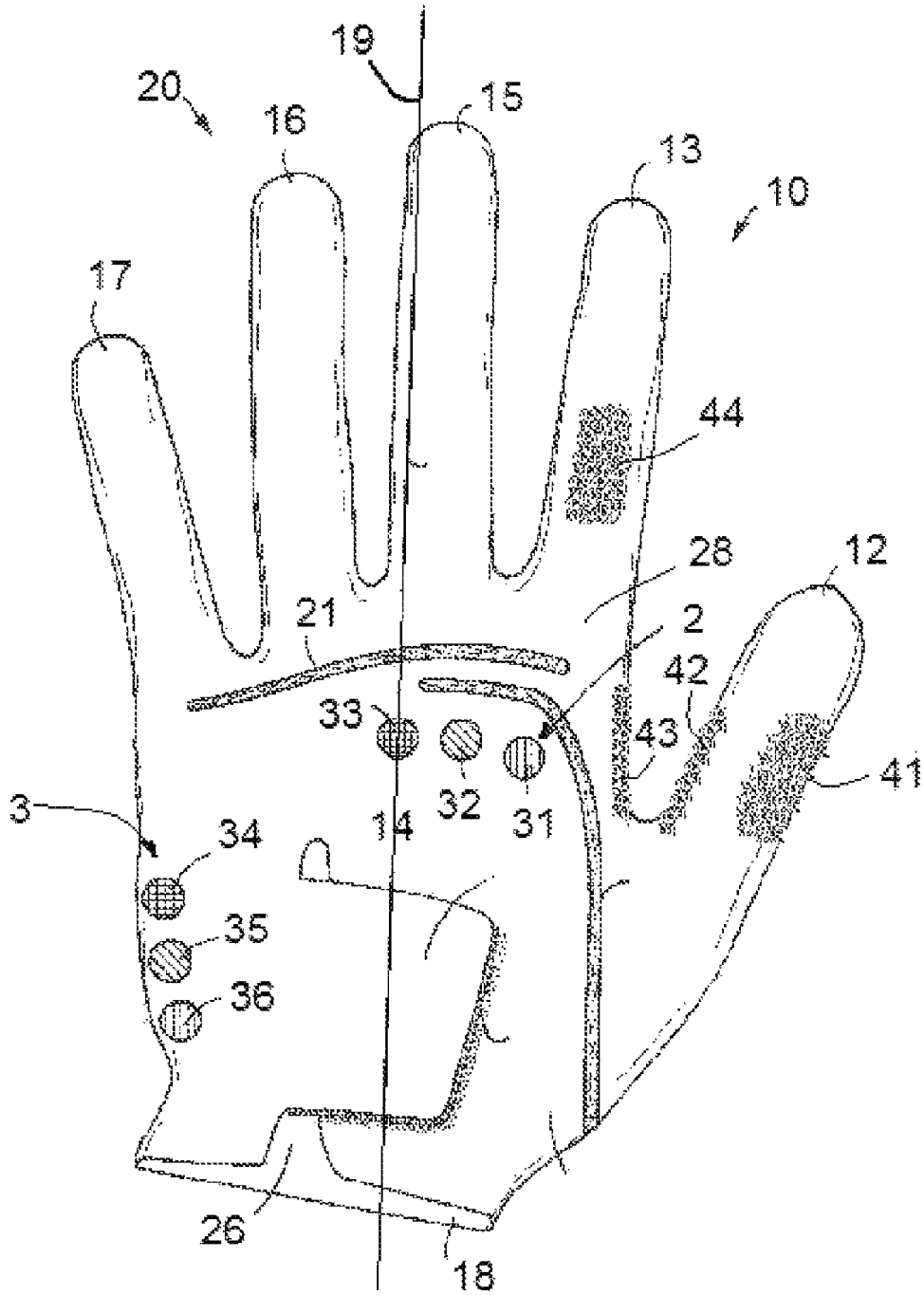
FIG. 2 is a top plan view of the upper hand of a first embodiment of the Golf Grip Training Glove.

A first embodiment consists of two gloves 10, 60. FIG. 2 shows a first embodiment of upper hand glove 10. Glove 10 has a back side portion 14 having an open end 18, a closed finger portion 20 having an index finger pocket 13, a middle finger pocket 15, a ring finger pocket 16, a pinky finger pocket 17, and a thumb pocket 12. The thumb pocket 12 and finger portion 20 are affixed to palm portion 23 and back side portion 14 by a seam which may be located at any location sufficient to attach each portion together. Finger pockets 13, 15, 16, 17 join the palm portion 23 of the glove above the knuckle section 28 for the golfer's fingers closest to the palm portion 23.

Back side portion 14 of upper hand glove 10 is split 26 at open end 18. On back side portion 14 a hook and loop fastener 24 is releasably connected to flange 25. Hook and loop fastener 27 can be engaged to permit glove 10 to fit snugly around a golfer's 1 hand. Back side portion 14 of glove 10 has elongated elastic member 21 adjacent a knuckle section 28, and a thumb section 12. The knuckle section 28 of glove 10 is adjacent the hand joints at the base of fingers of golfer 1.

Figure 4:
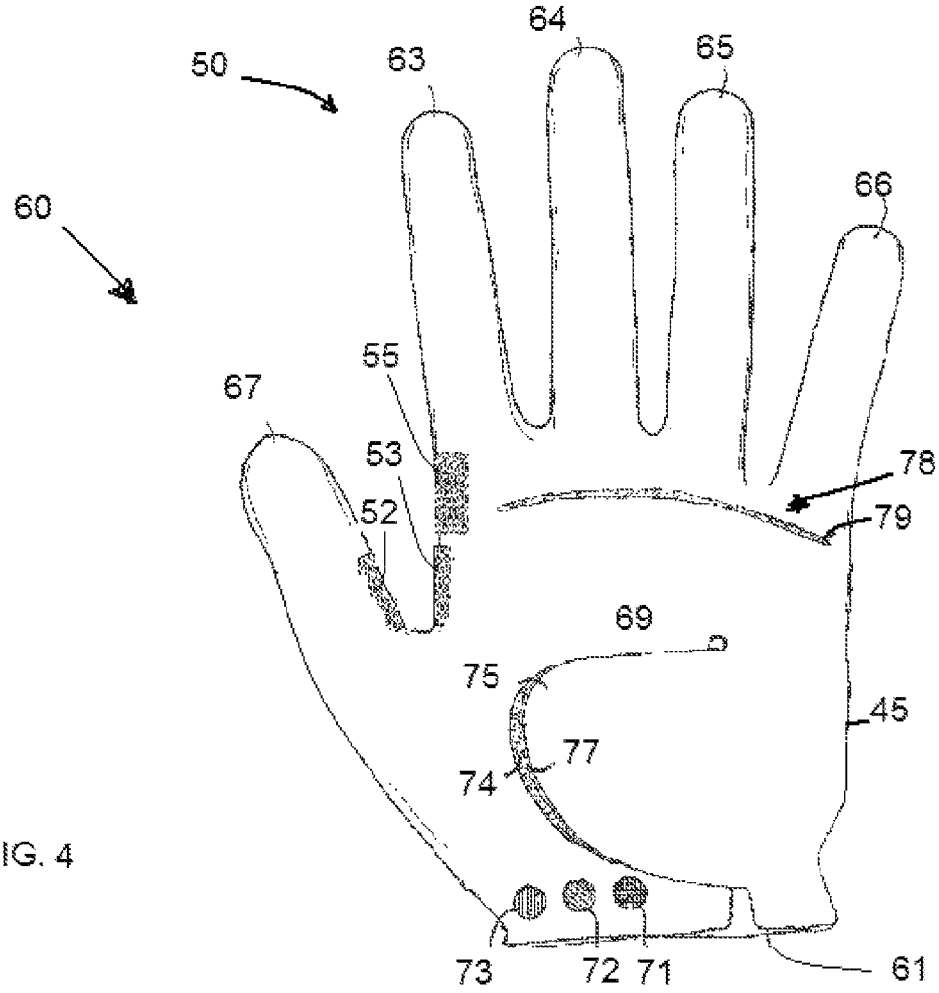
FIG. 4 is a top plan view of the lower hand of a first embodiment of the golf grip training glove.
Figure 5:
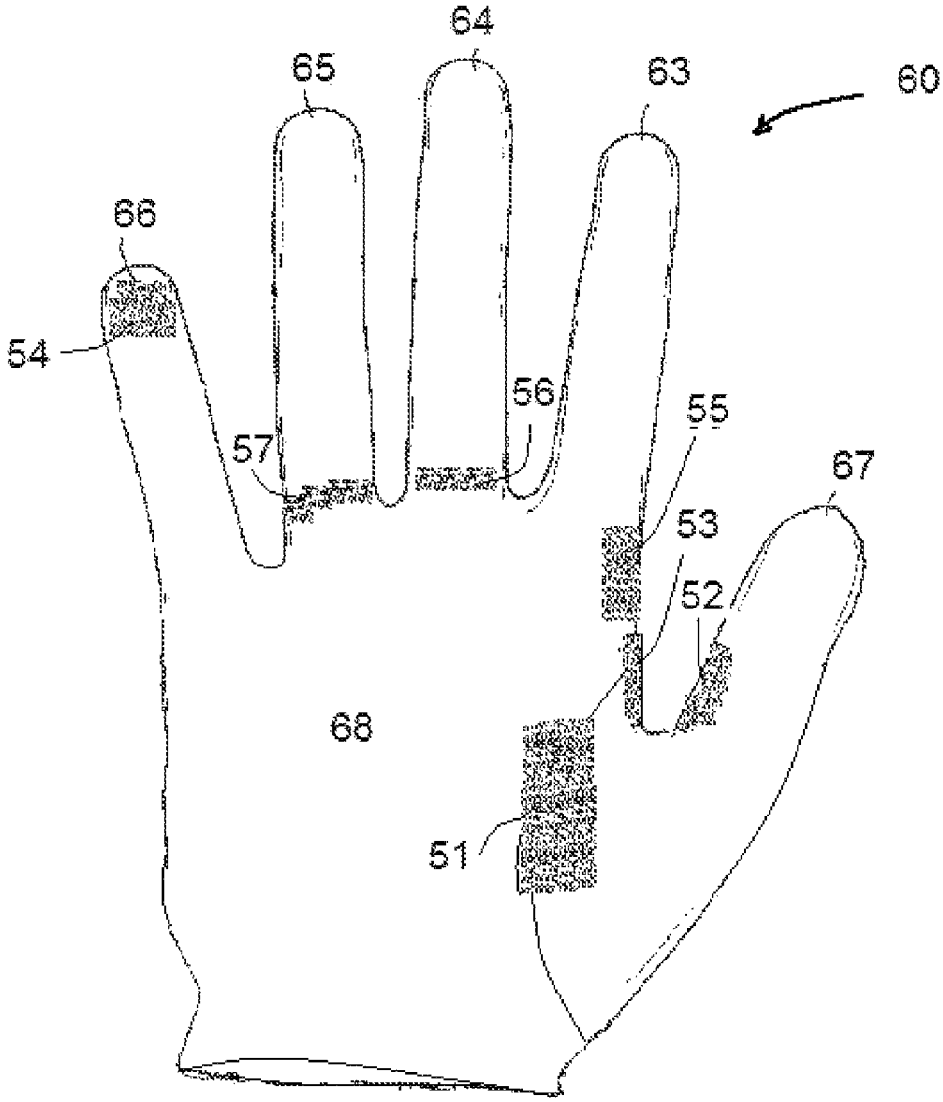
FIG. 5 is a bottom plan view of the lower hand of a first embodiment of the golf grip training glove.

FIG. 4 shows a first embodiment of a lower hand golf grip glove 60. Glove 60 has a back side portion 69 having an open end 61, a closed finger portion 50 having an index finger pocket 63, a middle finger pocket 64, a ring finger pocket 65, a pinky pocket 66, and a thumb pocket 67. The thumb pocket 67 and finger portion 50 are affixed to palm portion 68 and back side portion 69 by a seam which may be located at any location sufficient to attach each portion together. Finger pockets 63, 64, 65, 66 join palm portion 68 above knuckle section 78 closest to palm portion 68.

Back side portion 69 of lower hand glove 60 is split 26 at open end 61. On back side portion 69, hook and loop fastener 74 is releasably connected to flange 75. Hook and loop fastener 77 can be engaged to permit glove 60 to fit snugly around a golfer's hand. Back side portion 69 of glove 60 has elongated elastic member 79 adjacent a knuckle section 78 and a thumb section 67. The knuckle section 78 of glove 60 is adjacent the hand joints at the base of the fingers of golfer 1.

Upper hand glove 10 and lower hand glove 60 may be constructed of any suitable material having an elastic nature. The glove may alternatively be constructed of natural or synthetic polymers, including but not limited to: leather, cotton, wool or acrylic material.

Upper hand glove 10 and lower hand glove 60 may be constructed with any suitable thickness of the material to prevent wear while retaining a sensitive-to-the-touch feel of the golf club grip 100 with the hand of golfer 1.

Upper hand glove 10 and lower hand glove 60 may be of any desired size to fit comfortably the hand of the wearer. As shall be described below, the hand gloves 10, 60 are worn by the wearer to grip the handle of a golf club 100. A relatively tight-fit of the hand gloves 10, 60 about the hands of the wearer facilitates the gripping of the club 100. Therefore, the hand gloves 10, 60 are advantageously, although not necessarily, sized to the hand size of the wearer.

The glove 10 is designed to engage with a golf club grip 100. Grip 100 consists of a hook or loop material which is engagable with the various hook or loop fasteners affixed to the gloves 10, 60. Upper golf glove 10, lower golf glove 60 and golf club grip 100 are adapted to securely mate with each other using conventional hook and loop type pad fasteners.

A first embodiment includes visual indicia 2 spaced evenly on back hand covering 26 of upper hand glove 10. Indicia 2 are spaced horizontally on glove 10 to provide the golfer with visual guidance for rotating the golfers hand about grip 100. This slight rotation of the position of the glove 10 achieves a difference in the flight pattern for the golf ball 11 achieved by the golfer's swing. A first embodiment allows for some variability in the preferred method of swinging golf club 5 such that a golfer 1 may express a golf ball flight pattern preference. In addition, further indicia 3 are placed vertically on glove 10 to remind golfer 1 which direction corresponds to the individual indicia. Indicia 3 must reference their corresponding indicia 2 such that the golfer will be reminded of the particular shot associated with each indicia 2.

Visual indicia 2 comprises a first indicia 31 affixed in a position on the back side portion 14 of the glove 10 to provide a suitable visual reference for a desirable hand position relative to the club 5. Indicia 31 is positioned such that the golfer may only see indicia 31 from the vantage point of a correct rotational hand placement relative to the club 5. Indicia 31 must be of a suitably large size such that golfer 10 may visually identify the indicia 31 when positioned in the correct golf stance. Also, indicia 31 must be of suitably small size such that the indicia 31 will not be visible if the hand of golfer 1 is positioned incorrectly relative to the club 5. Visual indicia 31 may represent a fade golf ball flight pattern for a golf ball hit with golf club 5.

Similarly, a second indicia 32 may be affixed to the glove 10 of the present invention in a position on the back side portion 14 to provide a suitable visual reference for a second desirable hand position relative to the club 12. Indicia 32 may be positioned such that golfer 1 may only see exactly two indicia 31, 32 from the vantage point of a correct rotational hand placement relative to the club 5.

Similarly, a third indicia 33 may be affixed to the glove 10 in a position on the back side portion 14 to provide a suitable visual reference for a second desirable hand position relative to the club 5. Indicia 33 is positioned such that the golfer may only see exactly three indicia 31, 32, 33 from the vantage point of a correct rotational hand placement relative to the club 5.

In a further aspect, to account for the foreshortening effect of the angular vantage point of the golfer relative to glove 10, indicia 32 may positioned slightly closer to said finger portion 20 of glove 10 than indicia 31 such that indicia 31 and indicia 32 may appear to be spaced evenly about glove 10 when viewed from the angular vantage point of a correct golf position.

In another aspect, to account for the foreshortening effect of the angular vantage point of the golfer 1 relative to glove 10, indicia 33 may be positioned slightly closer to said finger portion 20 of glove 10 than indicia 31, 32 such that indicia 31, 32 and 33 appear to be spaced evenly about glove 10 when viewed from the angular vantage point of a correct golf position.

Indicia 31, 32, and 33 located on the upper thumb section 12 of back hand portion 14 of glove 10 comprises three spaced circular dots having contrasting colors. For example, indicia 31 is red, indicia 32 is green, and indicia 33 is yellow. For example, indicia 31-33 are each three eighths (⅜) inch diameter circular. The colors, designs and visual shapes of any indicia can be used as visual indicators on glove 10 for a specific hand placement relative to the club head 8. The individual indicia 31-33 may be positioned nearer to the golfer's wrist and generally concentric with the transverse convex curvature of knuckles section 28 of glove 10. The convex curvature of knuckles section 28 follows the transverse knuckle curvature of the golfer's hand. Visual indicia 33 is generally aligned with the longitudinal center line 19 of back hand portion 14 of glove 10. Visual indicia 31 and 32 are on the thumb side 12 of indicia 33.

Also, the first embodiment includes visual indicia 34, 35, and 36 spaced evenly on back hand portion 14 of glove 10. Indicia 34-36 are spaced vertically on the left side of glove 10 to provide the golfer 1 with a visual method of allowing for some variability in the preferred method of swinging the golf club 5 to allow for individual golf ball flight pattern preference. Visual indicia 34-36 are coordinated with visual indicia 31-33 to provide golfer 1 with a reference for a selected golf ball flight pattern, such as a fade, straight or draw golf ball flight pattern. For example, indicia 34-36 are red, green, and yellow colored round dots that correspond to red, green, and yellow round dots of indicia 31-33. Indicia 34-36 may function as a mental stimuli or reminder for golfer 10 of any selected desirable golf flight pattern. For example, where the indicia 33, and 34 are red, and the golfer desires a fade shot which curves right for a right handed golfer, the red coloring of indicia 34 is located the furthest right of the indicia 3 to remind the golfer of the hand position for a fade shot is indicated by the color red. The golfer 1 will then position his hands according to indicia 33, which is red in this example.

In a first embodiment illustrated in FIG. 2, fastener 42 is affixed in a position on the thumb pocket 12 of the upper hand glove 10 to provide a suitable contact area with fastener 43 such that the golfer's thumb pocket 12 does not move or slide relative to the palm area 23 of the users hand. Fastener 42 is affixed to the left side of thumb pocket 12 near to the golfer's thumb joint. Fastener 42 may be of suitable size such that fastener 43 may come into contact with and remains attached to fastener 43 throughout the golfer's swing while the golfer utilizes a desirable hand position for swinging golf club 5. The user may variously position the golf club grip 100 relative to the palm area 23 of the upper hand.

Figure 3:
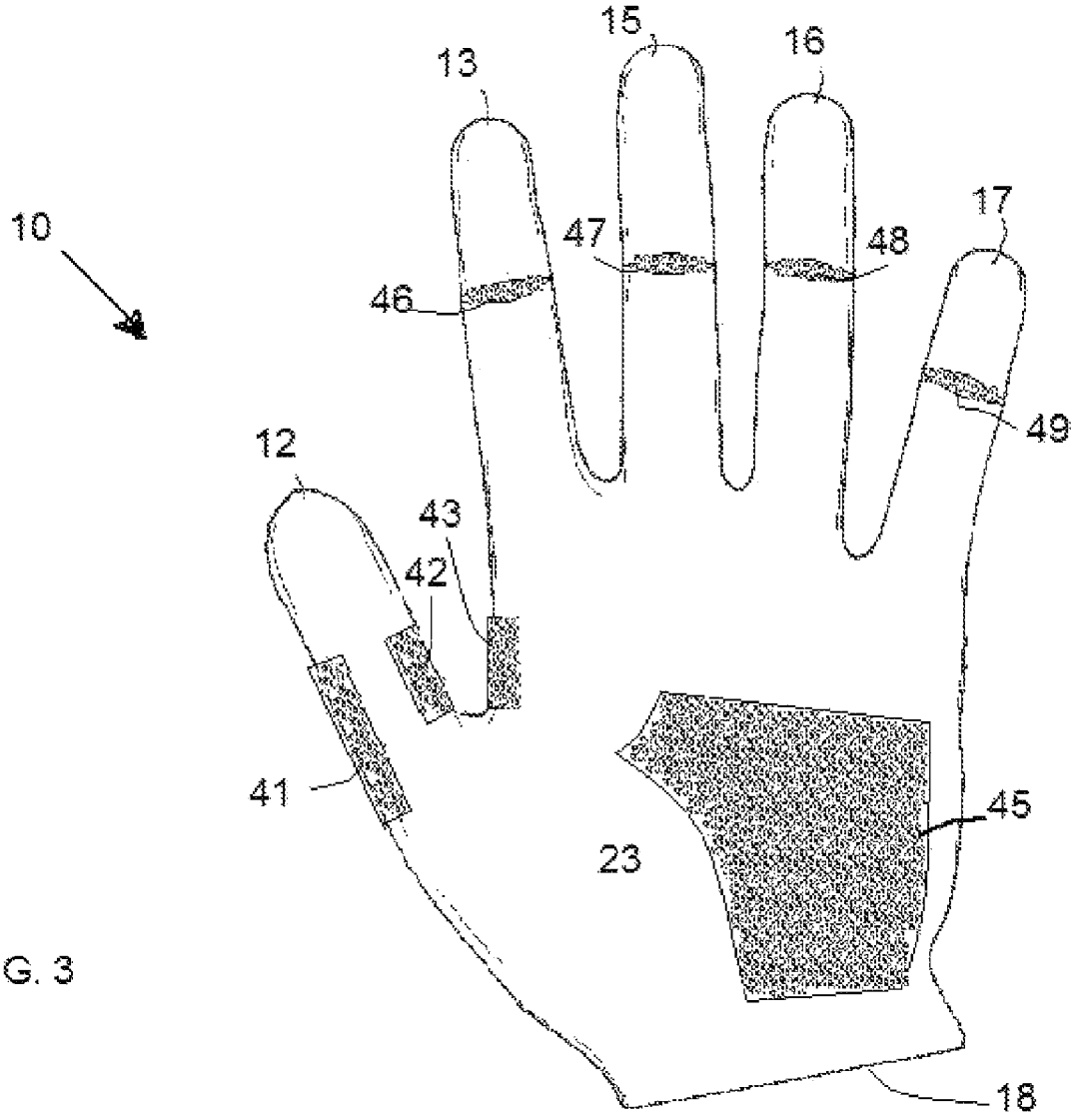
FIG. 3 is a bottom plan view of the upper hand of a first embodiment of the Golf Grip Training Glove.

Referring to FIG. 3, fastener 45 is positioned on palm part 23 of glove 10 to provide a suitable contact area with golf club grip 100 such that palm part 23 will not move relative to golf club grip 100 during the course of a desirable golf swing. Fastener 45 must be of suitable size such that golfer 1 may vary the placement of the upper hand according to preference.

Fasteners 46, 47, 48, and 49 are all positioned to provide a suitable contact area with the golf club grip 100 such that the grip 100 will not move or slide relative to finger pockets 13, 15, 16, 17 of glove 10. Fasteners 46, 47, 48, and 49 are all positioned such that pressure from the golfer's hand is applied in a manner designed to achieve a specific flight pattern for a golf ball. A first embodiment places the fasteners 46, 47, 48, and 49 between the proximal interphalangeal joints and the distal interphalangeal joints of the corresponding fingers 13, 15, 16, and 17. Therefore, hook and loop fastener 46 affixes the index finger pocket 13 to the golf club grip 100 such that the distance between the distal and proximal interphalangeal joints of the golfer's hand will not move relative to the club grip 100 during its use. Similarly, fastener 47 affixes the middle finger 15 to the golf club grip 100 such that the distance between the distal and proximal interphalangeal joints of the golfer's hand will not move relative to the club during its use. Similarly, the hook and loop fastener 48 affixes the ring finger 16 to the golf club grip 100 such that the distance between the distal and proximal interphalangeal joints of the golfer's hand will not move relative to the club grip 100 during its use. Similarly, fastener 49 affixes the pinky finger 17 to the golf club grip 100 such that the distance between the distal and proximal interphalangeal joints of the pinky finger 17 will not move relative to the club 100 during its use. In further embodiments discussed below, the same goal may be accomplished using further placement of hook and loop fasteners.

Fastener 41 is affixed to thumb pocket 12 of glove 10 in a position required to attach thumb pocket 12 to the palm portion 68 of glove 60. Mating hook or loop fastener 51 is affixed to the palm portion 68 of the glove 60. Fasteners 41, 51 releasably connect with each other or palm portion 68 when fastener 51 is placed directly over and in contact with fastener 41 during a desirable golf club grip. Fasteners 41, 51 may be of suitable size such that thumb pocket 12 will not move relative to palm portion 68 during the course of a desirable golf swing. Fasteners 41 and 51 also provide a tactile reference for the correct hand placement relative to each other in a correct golf club grip. During the course of a desirable golf club swing, the golfers hands would naturally contact with each other in the area covered by the mating fasteners 41, 51.

Similarly, fastener 44 is affixed to index finger pocket 13 of glove 10 in a position required to mate with fastener 54 and thereby attach finger pocket 13 to pinky pocket 67 of glove 60. Mating fasteners 44, 54 must be of suitable size such that index finger pocket 13 and pithy finger pocket 67 will not move relative to each other during the course of a desirable golf swing. In this embodiment, the golfers hands would contact each other such that pinky finger pocket would be positioned overlapping the index finger pocket 13 in what is known to one skilled in the art as a 'Vardon' grip. Alternatively, in a further embodiment, fastener 44 and 54 may be positioned to contact each other where the golfer's hands are placed in what is known to one skilled in the art as an 'interlocking' grip. In an 'interlocking' grip, the golfers index finger of the upper hand and the pinky finger of the lower hand are interlaced. Fasteners 44 and 54 also provide a tactile reference for the correct hand placement relative to each other in a correct golf club grip. During the course of a golf club swing, the hands of golfer 1 would naturally contact with each other in the area covered by the mating fasteners 44, 54.

Similarly, hook and loop fastener 41 may be positioned on the thumb pocket 12 of the upper hand glove 10 to provide a suitable contact area for hook and loop fastener 51 positioned on palm portion 68 of lower hand glove 60 such that both hands of golfer 1 remain in a desirable location relative to each other during the course of a golf swing. Hook and loop fastener 51 may be positioned on palm portion 68 such that the upper hand thumb is releasably connected in the correct position relative to the desired grip of the club and the overlaying lower hand. Both hook and loop fastener 51 and 61 may be of suitable size and position to allow a desired grip of the golf club and a means to fasten thumb pocket 12 in a desirable and correct position. Hook and loop fasteners 51 and 61 may be of suitable size to releasably connect palm portion 68 to thumb pocket 12 with enough force to withstand the normal pressures of a desired golf swing.

Hook and loop fastener 44 may be positioned on finger pocket 13 of glove 10 in order to provide a suitable contact area for hook and loop fastener 54 on finger pocket 66 of glove 60. Hook and loop fastener 54 may be positioned such that finger pocket 66 will releasably connect to finger pocket 13 in a golf grip. Hook and loop fasteners 44 and 54 must be of suitable size to releasably connect finger pockets 13 and 66 with enough force to withstand the normal pressures of a golf swing. Hook and loop fasteners 44 and 54 may be positioned in a manner which prevents the golfers hands from sliding or otherwise moving both radially and laterally relative to each other during the course of a golf swing. In a first embodiment, hook and loop fastener 44 may be positioned below the proximal interphalangeal joint of the index finger of the upper hand of the golfer. Also, hook and loop fastener 54 may be positioned above the radial interphalangeal joint of the pinky finger of the lower hand of the golfer.

Hook and loop fastener 52 may be positioned on thumb pocket 67 of glove 60 to provide a suitable contact area for hook and loop fastener 53. Hook and loop fastener 53 may be positioned on the palm portion 68 of the lower hand glove 60 such that thumb pocket 67 will remain is a desirable location relative to palm portion 68 throughout a desirable golf swing. Hook and loop fasteners 52 and 53 must be of suitable size to affix the fingers of the golfer with enough force to withstand the normal pressures of a golf swing.

Furthermore, hook and loop fasteners 55, 56 and 57 are all positioned to provide a suitable contact area with the grip of the golf club such that the club will not move or slide relative to the finger position of the golfer utilizing the correct grip. In a first embodiment, hook and loop fastener 57 may be positioned below the proximal interphalangeal joint of the ring finger of golfer 1. Similarly, hook and loop fastener 57 may be positioned below the proximal interphalangeal joint of middle finger pocket 65. Also, hook and loop fastener 55 may be positioned above the metacarpophalangeal joint of index finger pocket 63. Hook and loop fastener 55 extends around the metacarpophalangeal joint of the index finger such that the user may variously position the club grip 100 relative to the index finger of the golfer's 1 lower hand.

Figure 6:
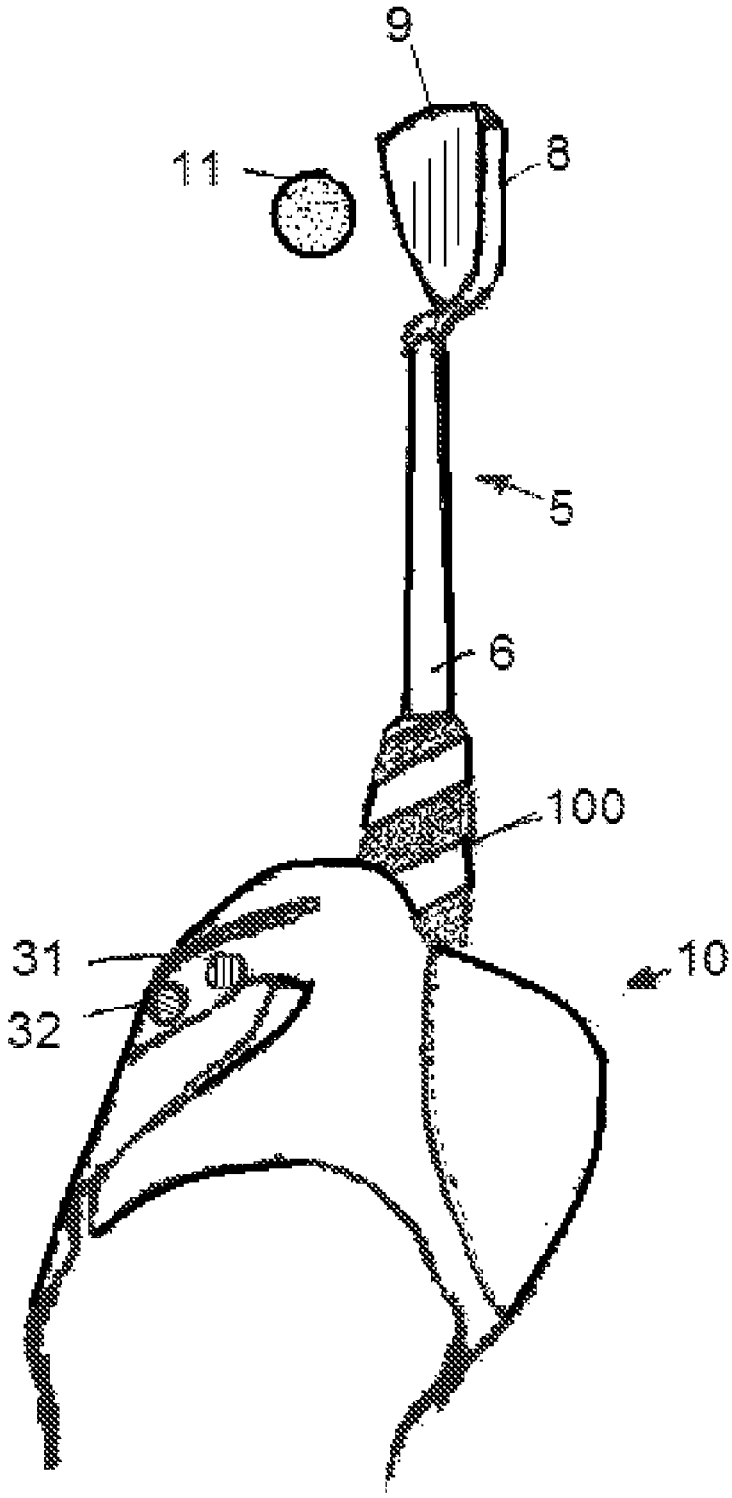
FIG. 6 is a perspective view of the upper hand of the golf grip training glove of the invention interfacing with a first embodiment of the golf club grip.

FIG. 6 illustrates an embodiment of the invention from the vantage point of a golfer 1. Golfer 1 is gripping golf club grip 100 with only upper hand glove 10 in a second desirable hand position in preparation for a straight shot. In the first embodiment, only the first and second indicia 31, 32 are visible from the vantage point of the golfer 1. In use, golfer 1 grips golf club 5 in a first upper hand position wherein golfer 1 observes only indicia 31 to achieve a fade golf ball flight pattern. When golfer 1 grips golf club 5 in a second hand position, only indicia 31 and 32 are observable. Second hand position achieves a straight golf ball flight pattern. When golfer 1 grips golf club 5 in a third hand position, all three indicia 31, 32, and 33 are observable. Third hand position achieves a draw golf ball flight pattern. Each desirable hand position requires golfer 1 to align golf club head 8 such that golf club face 9 is perpendicular to the desired target for golf ball 11.

Figure 7:
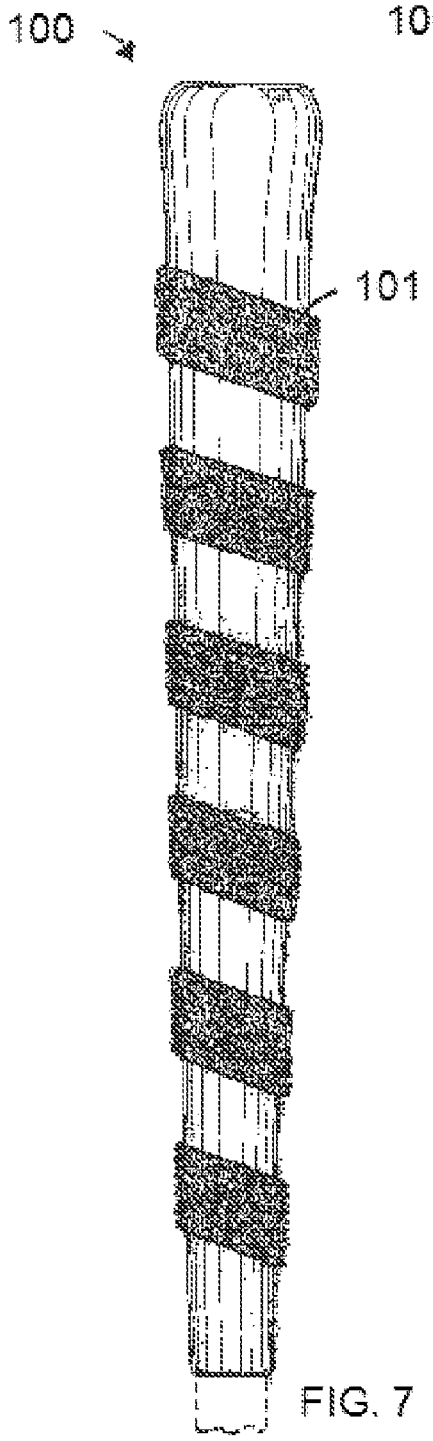
FIG. 7 is a front elevational view of a first embodiment of the golf club grip with a helical band of loop members located around the grip.
Figure 8:
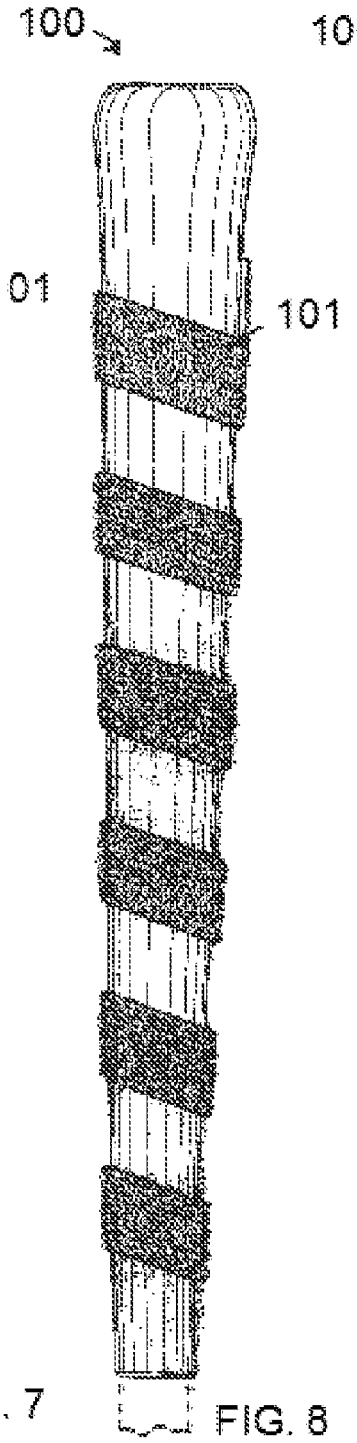
FIG. 8 is a side elevational view of the right side of FIG. 7.
Figure 9:
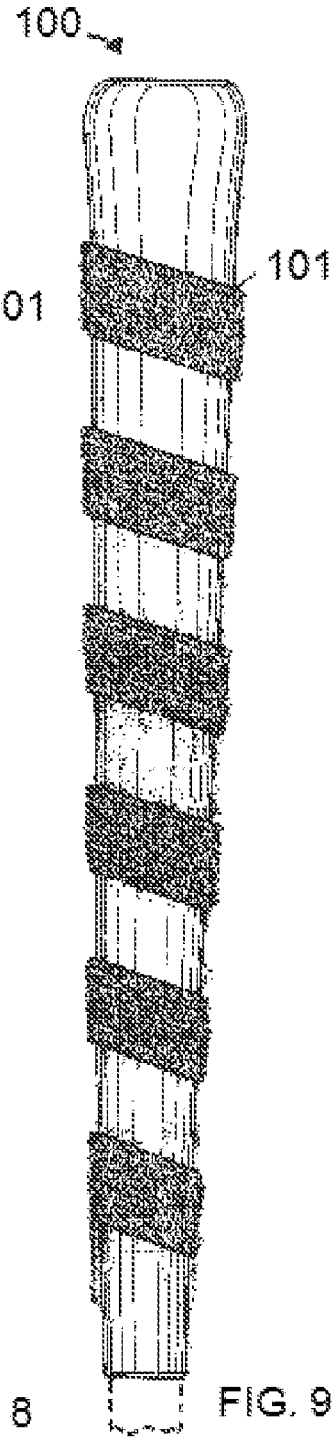
FIG. 9 is a side elevational view of the left side of FIG. 7.
Figure 10:
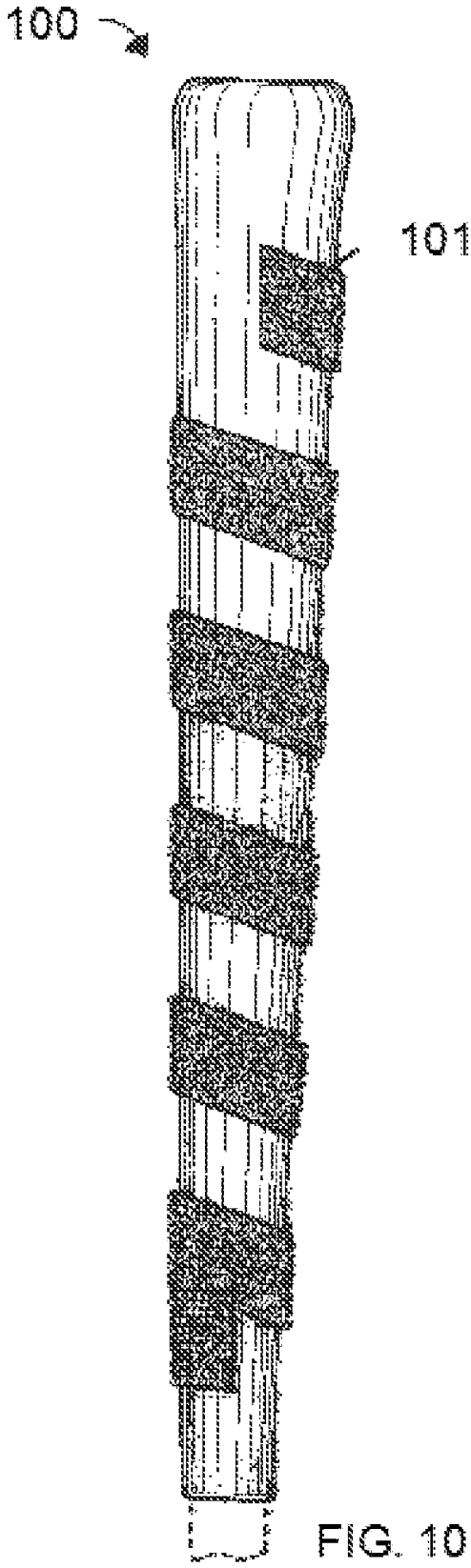
FIG. 10 is a rear elevational view of FIG. 7.
Figure 11:
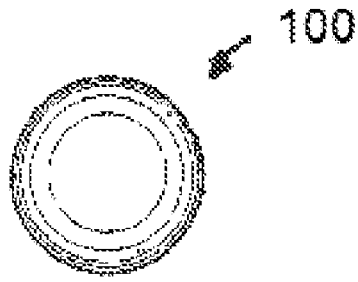
FIG. 11 is a top plan view of FIG. 7.
Figure 12:
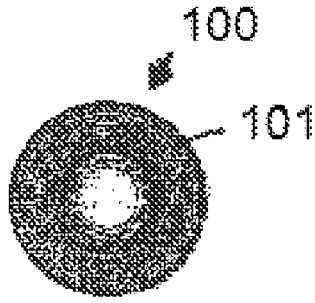
FIG. 12 is a bottom plan view of FIG. 7.

Referring to FIG. 7, a first embodiment of golf club grip 100 is shown. Conventional hook and loop fastener 101 may be affixed to golf club grip 100 such that fasteners 45, 46, 47, 48, 49, 55, 56, and 57 releasably connect to grip 100 such that hands of golfer 1 will remain in a fixed position relative to grip 100 and each other throughout the course of a golf swing. Hook and loop fastener 101 maybe alternatively wrapped around, slipped over or otherwise placed such that that they cover grip 100 sufficiently to provide contact with fasteners 45, 46, 47, 48, 49, 55, 56, and 57 or any combination therein.

Figure 13:
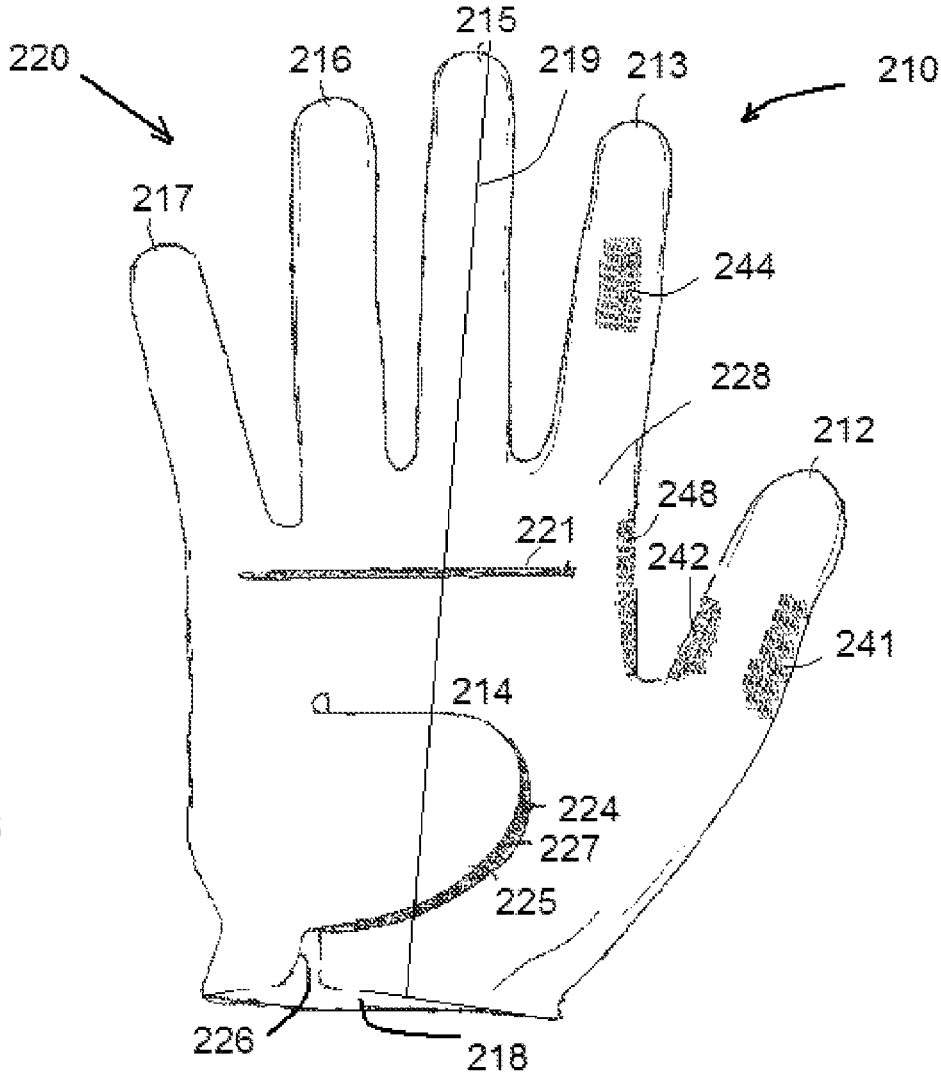
FIG. 13 is a top plan view of the upper hand of a second embodiment of the Golf Grip Training Glove.

In a second embodiment illustrated in FIG. 13, fastener 242 is affixed in a position on the thumb pocket 212 of the upper hand glove 210 to provide a suitable contact area with fastener 243 such that the golfer's thumb pocket 212 does not move or slide relative to the palm area 223 of the users hand. Fastener 242 is affixed to the left side of thumb pocket 212 near to the golfer's thumb joint. Fastener 242 may be of suitable size such that fastener 243 may come into contact with and remains attached to fastener 243 throughout the golfer's swing while the golfer utilizes a desirable hand position for swinging golf club 5. The user may variously position the golf club grip 100 relative to the palm area 223 of the upper hand.

Figure 14:
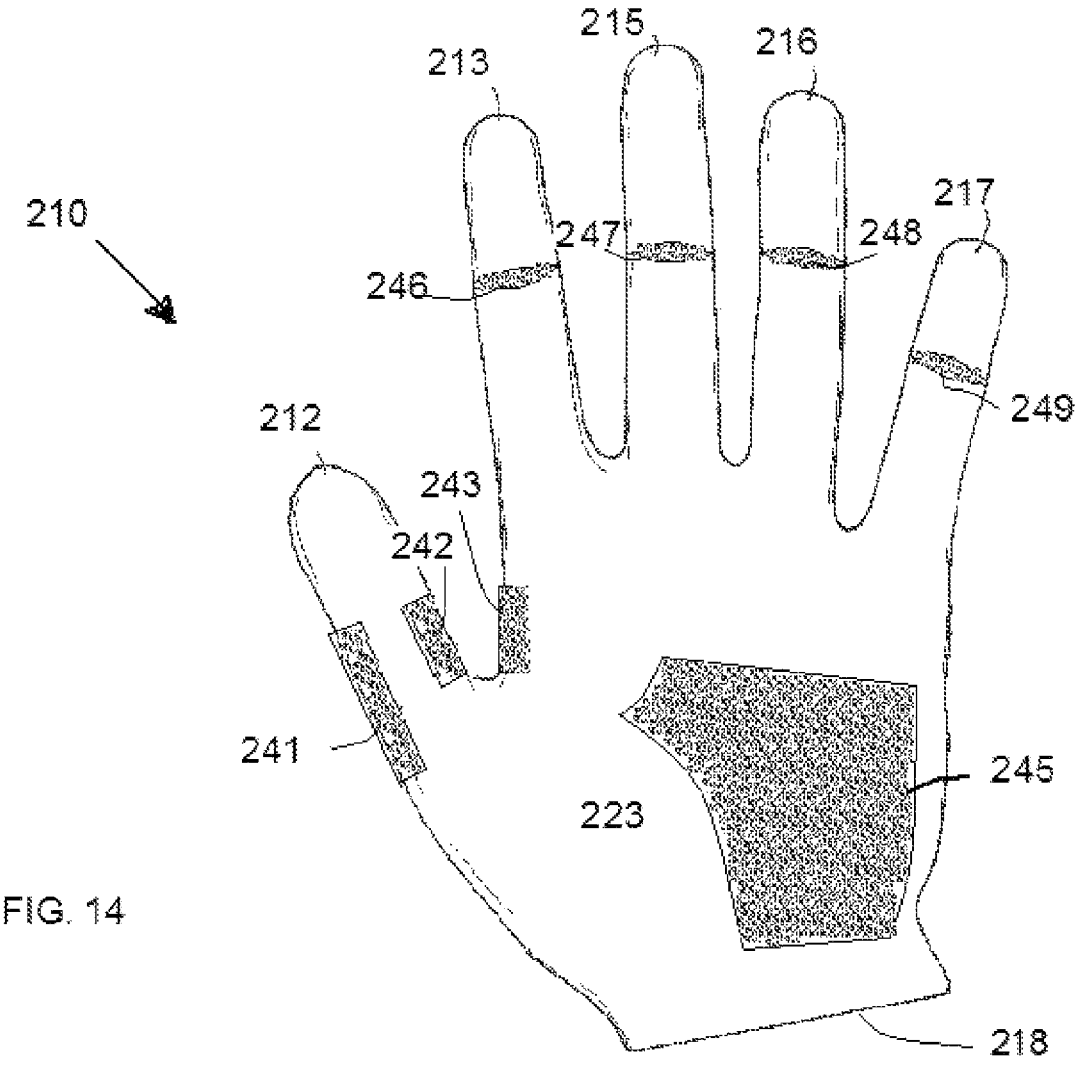
FIG. 14 is a bottom plan view of the upper hand of a second embodiment of the golf grip training glove.

Referring to FIG. 14, fastener 245 is positioned on palm part 223 of glove 210 to provide a suitable contact area with golf club grip 100 such that palm part 223 will not move relative to golf club grip 100 during the course of a desirable golf swing. Fastener 245 must be of suitable size such that golfer 1 may vary the placement of the upper hand according to preference.

Fasteners 246, 247, 248, and 249 are all positioned to provide a suitable contact area with the golf club grip 100 such that the grip 100 will not move or slide relative to finger pockets 213, 215, 216, 217 of glove 210. Fasteners 246, 247, 248, and 249 are all positioned such that pressure from the golfer's hand is applied in a manner designed to achieve a specific flight pattern for a golf ball. A second embodiment places the fasteners 246, 247, 248, and 249 between the proximal interphalangeal joints and the distal interphalangeal joints of the corresponding fingers 213, 215, 216, and 217. Therefore, hook and loop fastener 246 affixes the index finger pocket 213 to the golf club grip 100 such that the distance between the distal and proximal interphalangeal joints of the hand of golfer 1 will not move relative to the club grip 100 during its use. Similarly, fastener 247 affixes the middle finger 215 to the golf club grip 100 such that the distance between the distal and proximal interphalangeal joints of the hand of golfer 1 will not move relative to the club during its use. Similarly, the hook and loop fastener 248 affixes the ring finger 216 to the golf club grip 100 such that the distance between the distal and proximal interphalangeal joints of the golfer's hand will not move relative to the club grip 100 during its use. Similarly, fastener 249 affixes the pinky finger 217 to the golf club grip 100 such that the distance between the distal and proximal interphalangeal joints of the pinky finger 217 will not move relative to the club 100 during its use. In further embodiments discussed below, the same goal may be accomplished using further placement of hook and loop fasteners.

Fastener 241 is affixed to thumb pocket 212 of glove 210 in a position required to attach thumb pocket 212 to the palm portion 268 of glove 260. Mating hook or loop fastener 251 is affixed to the palm portion 268 of the glove 260. Fasteners 241, 251 releasably connect with each other or palm portion 268 when fastener 251 is placed directly over and in contact with fastener 241 during a desirable golf club grip. Fasteners 241, 251 may be of suitable size such that thumb pocket 212 will not move relative to palm portion 268 during the course of a desirable golf swing. Fasteners 241 and 251 also provide a tactile reference for the correct hand placement relative to each other in a correct golf club grip. During the course of a desirable golf club swing, the golfers hands would naturally contact with each other in the area covered by the mating fasteners 241, 251.

Similarly, fastener 244 is affixed to index finger pocket 213 of glove 210 in a position required to mate with fastener 254 and thereby attach finger pocket 213 to pinky pocket 267 of glove 260. Mating fasteners 244, 254 must be of suitable size such that index finger pocket 213 and pinky finger pocket 267 will not move relative to each other during the course of a desirable golf swing. In this embodiment, the golfers hands would contact each other such that pinky finger pocket would be positioned overlapping the index finger pocket 213 in what is known to one skilled in the art as a 'Vardon' grip. Alternatively, in a further embodiment, fastener 44 and 54 may be positioned to contact each other where the golfer's hands are placed in what is known to one skilled in the art as an 'interlocking' grip. In an 'interlocking' grip, the golfer's index finger of the upper hand and the pinky finger of the lower hand are interlaced. Fasteners 244 and 254 also provide a tactile reference for the correct hand placement relative to each other in a correct golf club grip. During the course of a golf club swing, the golfers hands would naturally contact with each other in the area covered by the mating fasteners 244, 254.

Similarly, hook and loop fastener 241 may be positioned on the thumb pocket 225 of the upper hand glove 210 to provide a suitable contact area for hook and loop fastener 251 positioned on palm portion 268 of lower hand glove 260 such that both hands of golfer 1 remain in a desirable location relative to each other during the course of a golf swing. Hook and loop fastener 251 may be positioned on palm portion 268 such that the upper hand thumb is releasably connected in the correct position relative to the desired grip of the club and the overlaying lower hand. Both hook and loop fastener 51 and 61 may be of suitable size and position to allow a desired grip of the golf club and a means to fasten thumb pocket 212 in a desirable and correct position. Hook and loop fasteners 251 and 261 may be of suitable size to releasably connect palm portion 268 to thumb pocket 212 with enough force to withstand the normal pressures of a desired golf swing.

Hook and loop fastener 244 may be positioned on finger pocket 213 of glove 210 to provide a suitable contact area for hook and loop fastener 254 on finger pocket 267 of glove 260. Hook and loop fastener 254 may be positioned such that finger pocket 267 will releasably connect to finger pocket 213 in a golf grip. Hook and loop fasteners 244 and 254 must be of suitable size to releasably connect finger pockets 213 and 267 with enough force to withstand the normal pressures of a golf swing. Hook and loop fasteners 244 and 254 may be positioned in a manner which prevents the golfers hands from sliding or otherwise moving both radially and laterally relative to each other during the course of a golf swing. In a second embodiment, hook and loop fastener 244 may be positioned below the proximal interphalangeal joint of the index finger of the upper hand of the golfer. Also, hook and loop fastener 254 may be positioned above the radial interphalangeal joint of the pinky finger of the lower hand of the golfer.

Hook and loop fastener 252 may be positioned on thumb pocket 226 of glove 260 to provide a suitable contact area for hook and loop fastener 253. Hook and loop fastener 253 may be positioned on the palm portion 224 of the lower hand glove 260 such that thumb pocket 267 will remain is a desirable location relative to palm portion 268 throughout a desirable golf swing. Hook and loop fasteners 252 and 253 must be of suitable size to affix the fingers of the golfer with enough force to withstand the normal pressures of a golf swing.

Furthermore, hook and loop fasteners 255, 256 and 257 are all positioned to provide a suitable contact area with the grip of the golf club such that the club will not move or slide relative to the finger position of the golfer utilizing the correct grip. In a second embodiment, hook and loop fastener 257 may be positioned below the proximal interphalangeal joint of the ring finger of golfer 1. Similarly, hook and loop fastener 214 may be positioned below the proximal interphalangeal joint of middle finger pocket 265. Also, hook and loop fastener 215 may be positioned above the metacarpophalangeal joint of index finger pocket 263. Hook and loop fastener 215 extends around the metacarpophalangeal joint of the index finger such that the user may variously position the club grip 100 relative to the index finger of the golfer's 1 lower hand.

Figure 15:
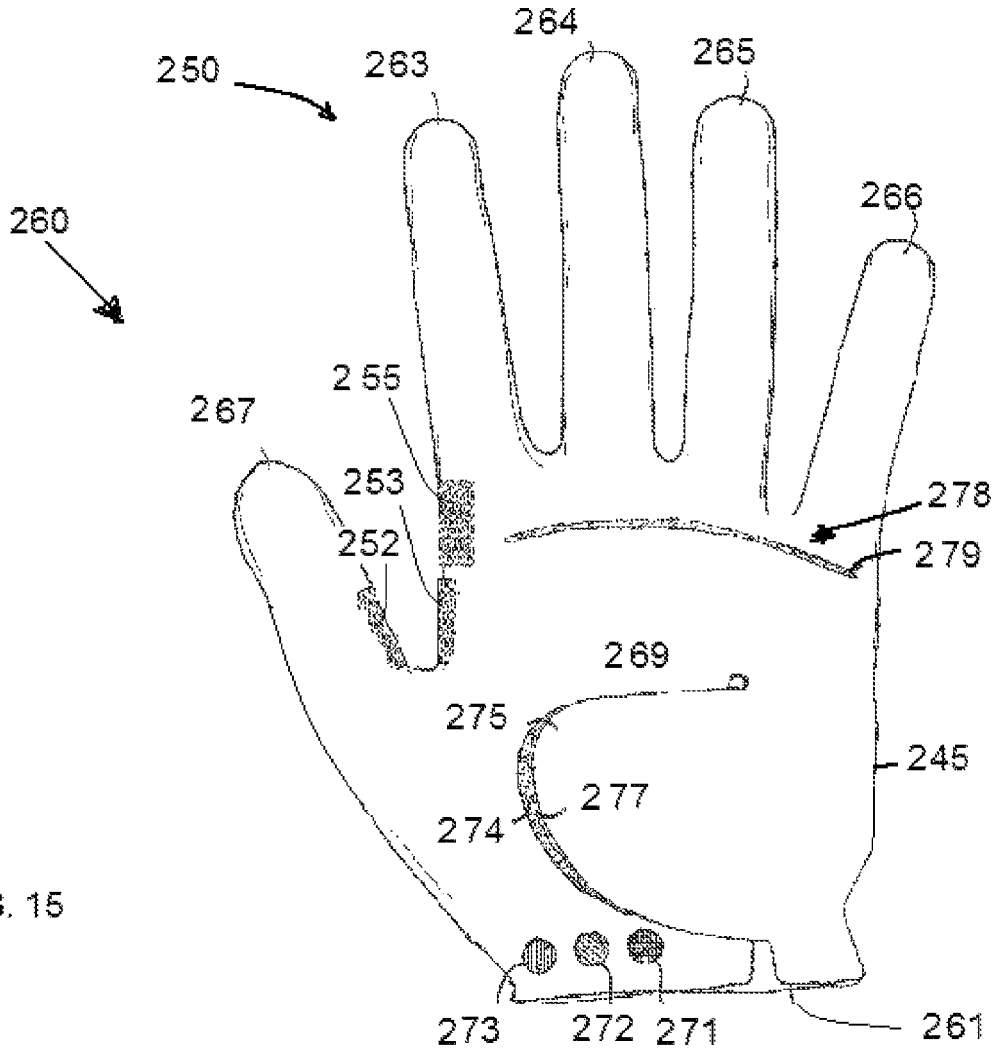
FIG. 15 is a top plan view of the lower hand of a second embodiment of the Golf Grip Training Glove.
Figure 16:
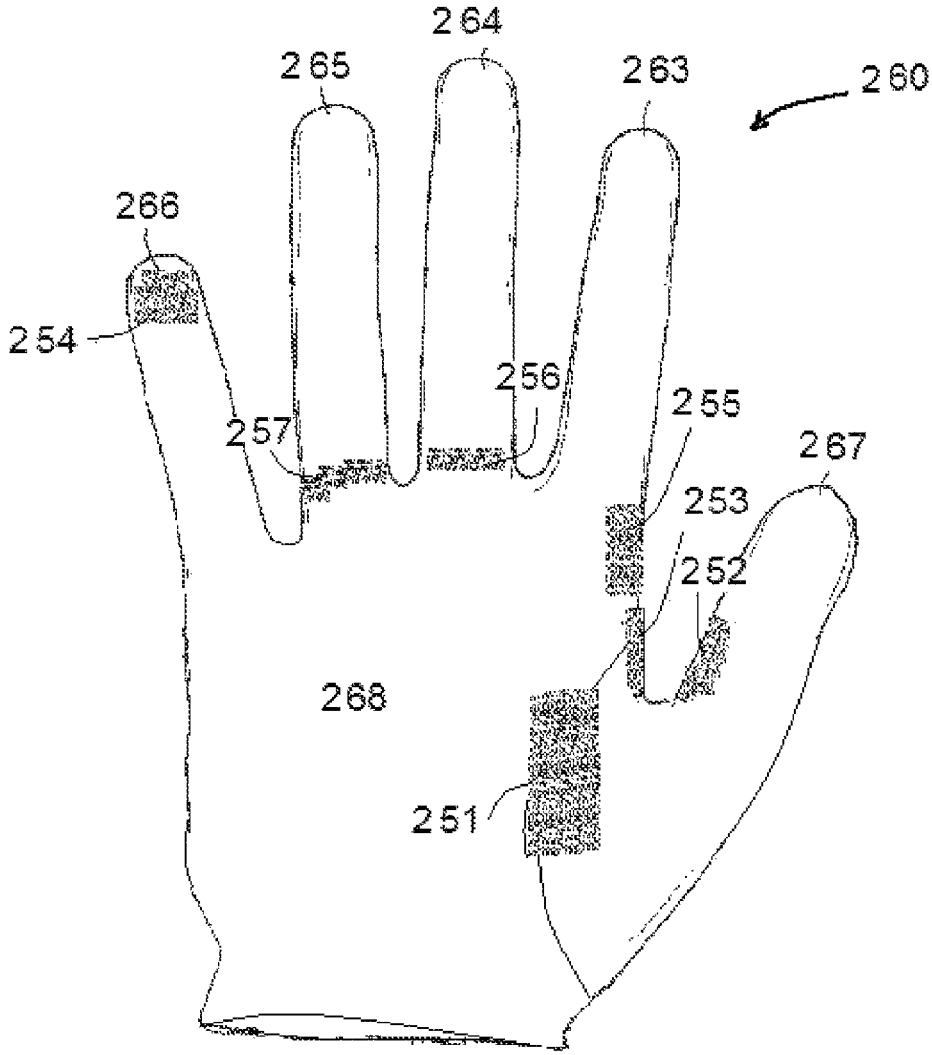
FIG. 16 is a bottom plan view of the lower hand of a second embodiment of the Golf Grip Training Glove.

FIG. 15 shows a second embodiment of a lower hand golf grip glove 260. Glove 260 has a back side portion 269 having an open end 261, a closed finger portion 250 having an index finger pocket 263, a middle finger pocket 264, a ring finger pocket 265, a pinky pocket 266, and a thumb pocket 267. The thumb pocket 267 and finger portion 250 are affixed to palm portion 268 and back side portion 269 by a seam which may be located at any location sufficient to attach each portion together. Finger pockets 263, 264, 265, 266 join palm portion 268 above knuckle section 278 closest to palm portion 268.

Back side portion 269 of lower hand glove 260 is split 226 at open end 261. On back side portion 269, hook and loop fastener 274 is releasably connected to flange 275. Hook and loop fastener 277 can be engaged to permit glove 260 to fit snugly around a golfer's hand. Back side portion 269 of glove 260 has elongated elastic member 271 adjacent a knuckle section 278 and a thumb section 267. The knuckle section 278 of glove 260 is adjacent the hand joints at the base of golfer's 1 fingers.

Upper hand glove 210 and lower hand glove 260 may be constructed of any suitable material having an elastic nature. The glove may alternatively be constructed of natural or synthetic polymers, including but not limited to: leather, cotton, wool or acrylic material.

Upper hand glove 210 and lower hand glove 260 may be constructed with any suitable thickness of the material to prevent wear while retaining a sensitive-to-the-touch feel of the golf club grip 100 with the golfer's 1 hand.

Upper hand glove 210 and lower hand glove 260 may be of any desired size to fit comfortably the hand of the wearer. As shall be described below, the hand gloves 210, 260 are worn by the wearer to grip the handle of a golf club 100. A relatively tight-fit of the hand gloves 210, 260 about the hands of the wearer facilitates the gripping of the club 100. Therefore, the hand gloves 210, 260 are advantageously, although not necessarily, sized to the hand size of the wearer.

The glove 210 is designed to engage with a golf club grip 100. Grip 100 consists of a hook or loop material which is engagable with the various hook or loop fasteners affixed to the gloves 210, 260. Upper golf glove 210, lower golf glove 260 and golf club grip 100 are adapted to securely mate with each other using conventional hook and loop type pad fasteners.

Figure 17:
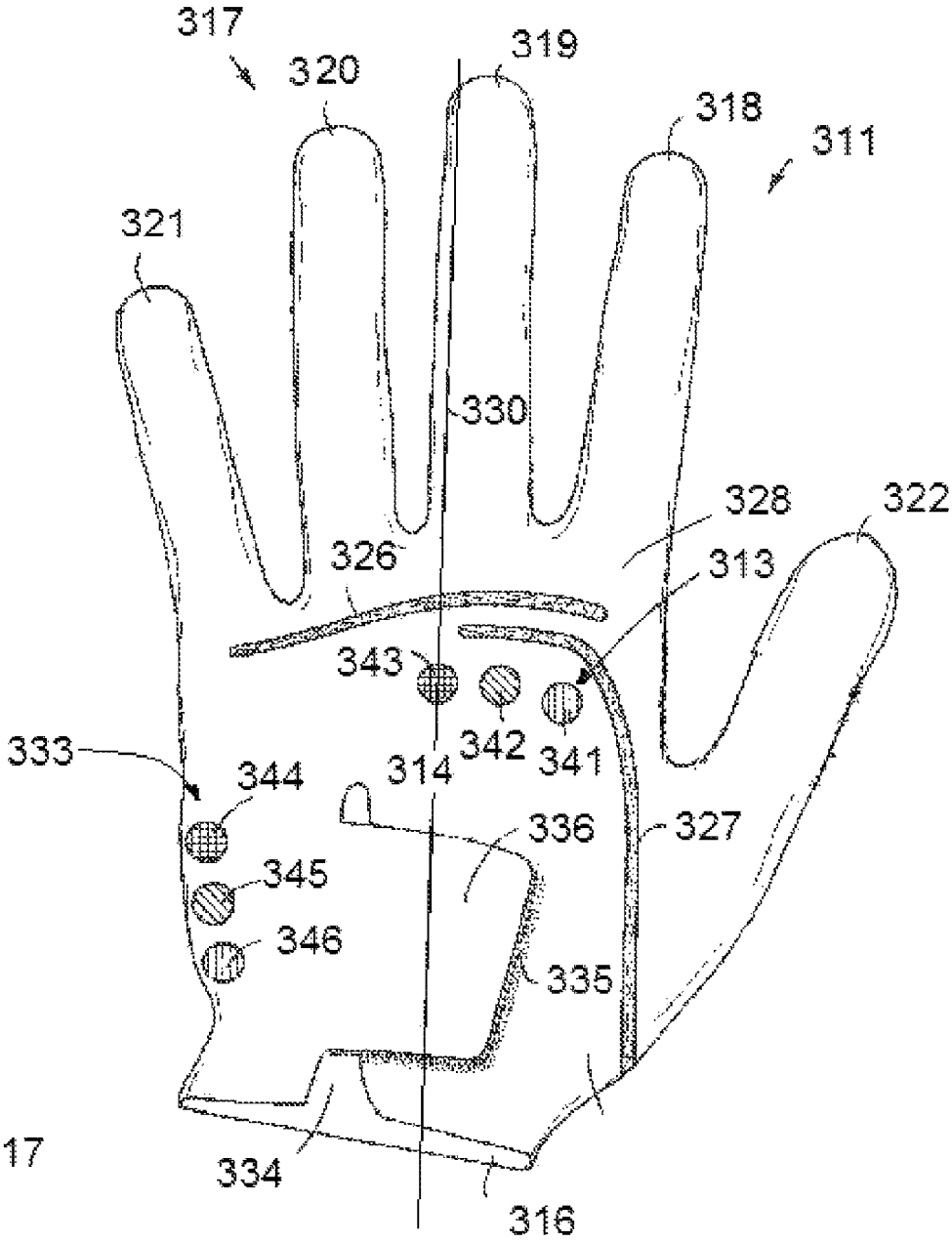
FIG. 17 is a top plan view of the upper hand of a third embodiment of the Golf Grip Training Glove.
Figure 18:
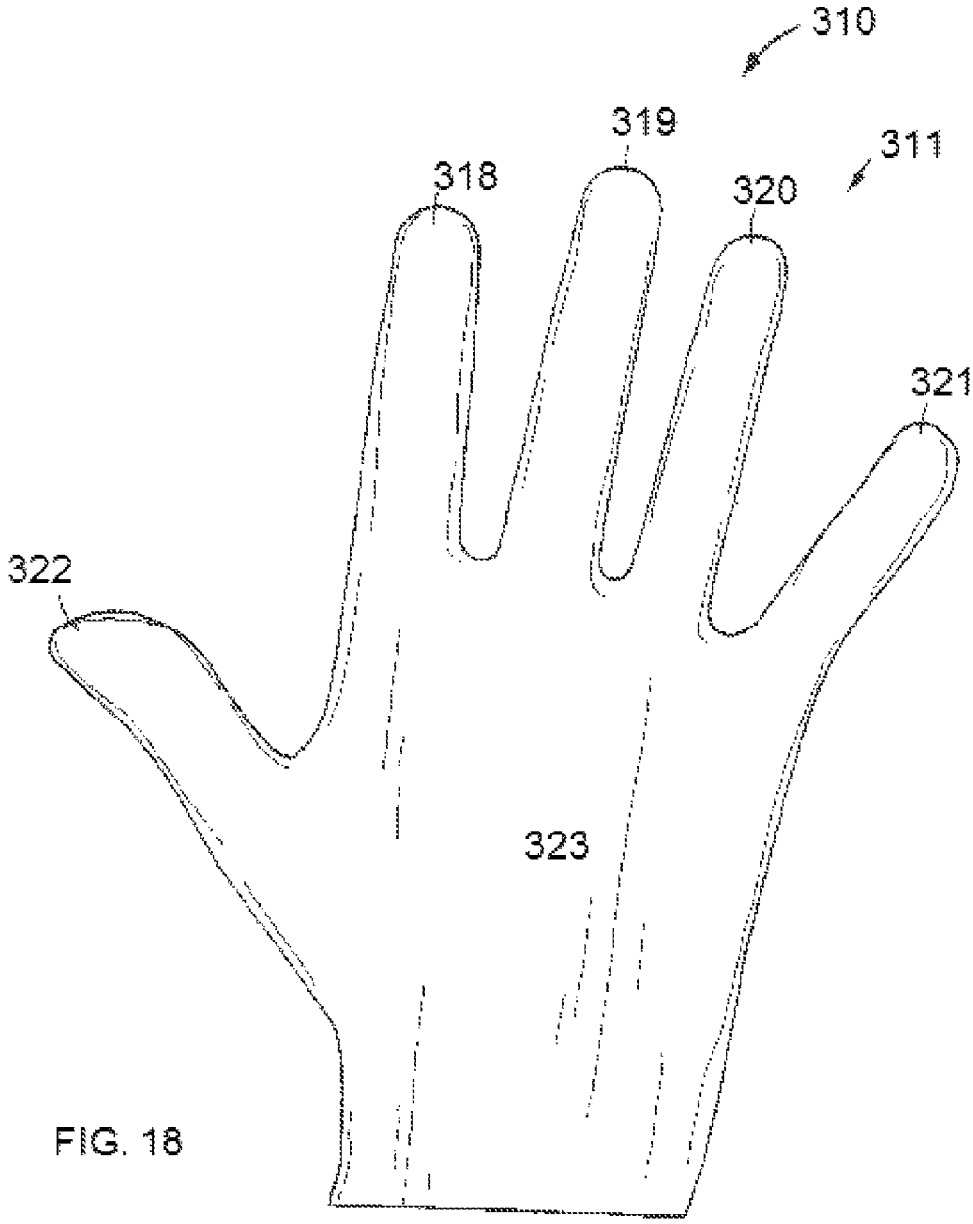
FIG. 18 is a bottom plan view of the upper hand of a third embodiment of the Golf Grip Training Glove.

Referring to FIG. 17, Glove 311 has a back side portion 314 having an open end 316, a closed finger portion 317 having an index finger 318, a middle finger 319, a ring finger 320, and a pinky 321, and a thumb 322. The back side portion of the glove is indicated at 314 and the palm side portion is indicated at 323. The thumb 322 and finger portion 317 is affixed to the palm portion 323 and the back side portion 314 by a seam which may be located at any location sufficient to attach each portion together. Fingers 318, 319, 320, 321 join the palm portion 323 of the glove above the knuckle section 328 for the golfer's fingers closest to the palm.

The back side portion 314 of the glove 311 is split 334 at the open end 316. On the thumb side 325 of back side portion 314 a hook and loop fastener 335 is releasably connected to a flange 336. The hook and loop fastener 335 can be engaged to permit the glove 311 to fit snugly around a golfer's 1 hand. The back side portion 314 of glove 311 has elongated elastic members 326 and 327 adjacent a knuckle section 328 and a thumb section 329 of glove 311. The knuckle section 328 of glove 311 is adjacent the hand joints at the roots of golfer's 1 fingers.

Visual indicia 313 comprises a first indicia 341 affixed in a position on the back side portion 314 of the glove 311 to provide a suitable visual reference for a desirable hand position relative to the club 5. Indicia 341 is positioned such that the golfer may only see indicia 341 from the vantage point of a correct rotational hand placement relative to the club 5. Indicia 341 must be of suitably large size for golfer 310 may visually identify the indicia 341 when positioned in the correct golf stance. Also, indicia 341 must be of suitably small size such that the indicia 341 will not be visible if the golfer's hand is positioned incorrectly relative to the club 5. Visual indicia 341 represents a fade golf ball flight pattern for a golf ball hit with golf club 5.

Similarly, a second indicia 342 is affixed to the glove 311 in a position on the back side portion 314 to provide a suitable visual reference for a second desirable hand position relative to the club 312. Indicia 342 is positioned such that golfer 310 may only see exactly two indicia 341, 342 from the vantage point of a correct rotational hand placement relative to the club 5.

Similarly, a third indicia 343 is affixed to the glove 311 in a position on the back side portion 314 in order to provide a suitable visual reference for a second desirable hand position relative to the club 5. Indicia 343 is positioned such that the golfer may only see exactly three indicia 341, 342, 343 from the vantage point of a correct rotational hand placement relative to the club 5.

In a further aspect, to account for the foreshortening effect of the angular vantage point of the golfer relative to glove 311, indicia 342 is positioned slightly closer to said finger portion 317 of glove 311 than indicia 341 such that indicia 341 and indicia 342 appear to be spaced evenly about glove 311.

Another aspect, to account for the foreshortening effect of the angular vantage point of the golfer relative to glove 311, indicia 343 is positioned slightly closer to said finger portion 317 of glove 311 than indicia 341, 342 such that indicia 341, 342 and 343 appear to be spaced evenly about glove 311.

Indicia 341, 342, and 343 located on thumb pocket 325 of back hand portion 314 of glove 311 comprises three spaced circular dots having contrasting colors. As an illustrative example, Dot 341 can be red. Dot 342 can be green. Dot 343 can be yellow. Dots 341-343 can be each three eighths (3/8) inch diameter circular. Any colors, designs and visual shapes including dots can be used as markings for visual indicia on glove 311. The individual indicia 341-433 are below and generally concentric with the transverse convex curvature of knuckles section 328 of glove 311. The convex curvature of knuckles section 328 follows the transverse knuckle curvature of the golfers hand. Visual indicia 343 is generally aligned with the longitudinal center line 330 of back hand portion 314 of glove 311. Visual indicia 341 and 342 are on the thumb side 326 of indicia 343.

Also a preferred embodiment includes visual indicia 344, 345, and 346 spaced evenly on back hand portion 314 of glove 311. Indicia 344-346 are spaced vertically on the left side of glove 311 to provide the golfer 310 with a visual method of allowing for some variability in the preferred method of swinging the golf club 5 to allow for individual golf ball flight pattern preference. Visual indicia 344-346 are coordinated with visual indicia 341-343 in a complementary manner to provide golfer 310 with a reference for a selected golf ball flight pattern, such as a fade, straight or draw golf ball flight pattern. For example, indicia 344-346 can be red, green, and yellow colored round dots that correspond in a complementary manner to red, green, and yellow round dots of indicia 341-343. Indicia 344-346 functions as a mental stimuli or reminder for golfer 310 of a selected desirable golf flight pattern. Where the golfer desires a fade shot, the red dot of indicia 346 is located the furthest left of the indicia 341 to remind the golfer that the red dot is a reference point for a draw shot, which curves left.

In use, golfer 310 grips golf club 5 in a first upper hand position wherein golfer 310 observes only indicia 341 to achieve a fade golf ball flight pattern. When golfer 310 grips golf club 5 in a second hand position, only indicia 341 and 342 are observable. Second hand position achieves a straight golf ball flight pattern. When golfer 310 grips golf club 5 in a third hand position, all three indicia 341, 342, and 343 are observable. This third hand position achieves a draw golf ball flight pattern. Thus, there are provided corresponding indicia pair 341 and 346, 342 and 345, and 343 and 344 which are believed to provide acceptable corresponding ball flight patterns.

Preferred embodiments of the golf glove and flight pattern indicia therein has been described and shown in the drawings. Changes and modifications of the golf gloves and visual indicia may be made by persons skilled in the art without departing from the invention.

I claim:

1. A golf training aid which includes:

a first upper hand glove having a palm side portion, a back hand side portion, a thumb pocket and a plurality of finger pockets characterized by:

a first indicia affixed to said back hand side portion of said upper hand glove such that a golfer observes said indicia while utilizing a first desirable hand position;

a second indicia affixed to said back hand portion of said upper hand glove such that a golfer observes said indicia while utilizing a second hand position;

a third indicia affixed to said back hand side which corresponds to said first indicia to provide an alignment aid across which a golf club is placed such that a golfer observes said indicia while utilizing said first desirable hand position; and a fourth indicia affixed to said back hand side portion which corresponds to said second indicia to provide an alignment aid across which a golf club is placed such that a golfer observes said indicia while utilizing said second hand position.

2. The golf training aid of claim 1, wherein said first upper hand glove includes a fifth indicia affixed to said back hand portion of said first upper hand glove such that a golfer observes said indicia while utilizing a third desirable hand position; and a sixth indicia affixed to said back hand side portion which corresponds to said fifth indicia to provide an alignment aid across which a golf club is placed such that a golfer observes said indicia while utilizing said third desirable hand position.

3. The golf training aid of claim 2, wherein said indicia are visually distinct from said glove and each of said fifth and sixth indicia are of like construction and color.

4. The golf training aid of claim 2, wherein said back hand portion of said first upper hand glove has a knuckle section and a thumb section, and said first, second and fifth indicia being affixed to the knuckle section of the back hand portion of the glove.

5. The golf training aid of claim 2, wherein said first upper hand glove transverse knuckle section has a convex configuration, and said first, second and fifth indicia have a convex alignment generally concentric with the convex configuration of said knuckle section of said back hand portion of aid first upper hand glove.

6. The golf training aid of claim 1, which includes a first pair of fasteners affixed to said first upper hand glove on said thumb pocket and a first finger pocket such that said first pair of fasteners will releasably connect so a golfer's thumb will remain in a desirable location relative to the golf club throughout the course of a golf swing.

7. The golf training aid of claim 6, which includes a second lower hand glove having a palm side portion, a back hand side portion, a thumb pocket and a plurality of finger pockets a second pair of fasteners affixed to said lower hand glove on said thumb pocket and a first finger pocket such that said second pair of fasteners will releasably connect so the golfer's thumb will remain in a desirable location relative to each other and golf club throughout the course of a golf swing.

8. The golf training aid of claim 7, which includes a third pair of fasteners affixed to said upper hand glove on said first finger pocket and said second glove on a second finger pocket such that said third pair of fasteners will releasably connect so the golfers upper hand index finger and lower hand pinky finger will remain in a desirable location relative to each other and a golf club throughout the course of a golf swing.

9. The golf training aid of claim 8, which includes a fourth pair of fasteners affixed to said upper hand glove on said thumb pocket and said lower hand glove on said palm side portion such that said fourth pair of fasteners will releasably connect so the golfers upper hand thumb and lower hand palm side portion will remain in a desirable location relative to each other and said golf club throughout the course of a golf swing.

10. The golf training aid of claim 9, which includes a ninth fastener affixed to said palm portion of said upper hand glove such that said ninth fastener releasably connects with a tenth fastener affixed to a golf club grip such that said palm portion will remain in a desirable position relative to said golf club throughout the course of a golf swing.

11. The golf training aid of claim 10, which includes a tenth fastener affixed to said golf club grip such that said tenth fastener releasably connects with a plurality of said fasteners affixed to said upper and lower glove such that said upper and lower glove will remain in a desirably position relative to said golf club throughout the course of a golf swing, and a plurality of fasteners affixed to said finger pockets such that said fasteners mate with said tenth fastener affixed to a golf club grip such that said finger pockets will remain in a desirable location relative to each other and said golf club grip throughout the course of a golf swing.

12. The golf training aid of claim 11, wherein said fasteners comprise hook and loop type pads such that each pad releasably connect.

13. The golf training aid of claim 1, which includes a second lower hand glove having a palm side portion, a back hand side portion, a thumb pocket and a plurality of finger pockets characterized by: a first lower hand indicia affixed to said back hand side portion of said lower hand such that a golfer may be reminded of said first desirable golf ball flight pattern.

14. The golf training aid of claim 13, which includes a second lower hand indicia affixed to said back hand side portion of said lower hand such that a golfer may be reminded of said second desirable golf ball flight pattern.

15. The golf training aid of claim 14, which includes a third lower hand indicia affixed to said back hand side portion of said lower hand such that a golfer may be reminded of said third desirable golf ball flight pattern.

16. The golf training aid of claim 1, wherein said indicia are visually distinct from said glove and each of said first and third indicia are of like construction and color and said second and fourth indicia are of like construction and color.

17. The golf training aid of claim 1, wherein the back hand portion of said first upper hand glove has a knuckle section and a thumb section, and said first and second indicia being affixed to the knuckle section of the back hand portion of said first upper hand glove.

18. The golf training aid of claim 1, wherein said first upper hand glove transverse knuckle section has a convex configuration, and said first and second indicia have a convex alignment generally concentric with the convex configuration of the knuckle section of the back hand portion of said first upper hand glove.

* * * * *